US006317680B1

(12) United States Patent
Luttrell et al.

(10) Patent No.: US 6,317,680 B1
(45) Date of Patent: Nov. 13, 2001

(54) AUTOMATIC AIRCRAFT ENGINE FUEL MIXTURE OPTIMIZATION

(75) Inventors: Jabe R. Luttrell, Burlington; Stephen Smith, Simsbury; Stephen Santoro, Windsor Locks, all of CT (US)

(73) Assignee: Aerosance, Inc., Farmington, CT (US)

( * ) Notice: Subject to any disclaimer, the term of this patent is extended or adjusted under 35 U.S.C. 154(b) by 0 days.

(21) Appl. No.: 09/268,181

(22) Filed: Mar. 15, 1999

(51) Int. Cl.[7] ..... F02D 43/04

(52) U.S. Cl. ..... 701/104; 701/102; 701/110; 123/478; 123/480; 123/349

(58) Field of Search ..... 701/104, 102, 701/103, 110; 123/349, 478, 479, 480, 494, 679, 689, 682, 693; 60/276, 285, 288

(56) References Cited

U.S. PATENT DOCUMENTS

| | | | | |
|---|---|---|---|---|
| 4,156,413 | * | 5/1979 | Taplin | 123/682 |
| 4,305,364 | * | 12/1981 | Stuckas | 123/676 |
| 4,452,207 | * | 6/1984 | Moore, Jr. | 123/676 |
| 4,643,147 | | 2/1987 | Staerzl | 123/676 |
| 5,121,324 | * | 6/1992 | Rini et al. | 701/105 |
| 5,168,853 | | 12/1992 | Kittelson et al. | 123/406.23 |
| 5,275,142 | | 1/1994 | Kapellen et al. | 123/436 |
| 5,284,116 | | 2/1994 | Richeson, Jr. | 123/406.2 |
| 5,615,655 | | 4/1997 | Shmizu | 123/406.24 |
| 5,685,283 | | 11/1997 | Nishioka et al. | 123/680 |
| 5,701,871 | | 12/1997 | Munakata et al. | 123/491 |
| 5,765,526 | | 6/1998 | Hara | 123/333 |
| 5,781,876 | * | 7/1998 | Saur | 701/93 |
| 5,797,261 | | 8/1998 | Akazaki et al. | 60/726 |
| 5,823,171 | | 10/1998 | Farmer et al. | 123/704 |
| 5,884,609 | | 3/1999 | Kawamoto et al. | 123/520 |
| 5,925,088 | * | 7/1999 | Nasu | 701/103 |
| 5,931,140 | * | 8/1999 | Maloney | 123/480 |

* cited by examiner

*Primary Examiner*—Henry C. Yuen
*Assistant Examiner*—Hieu T. Vo
(74) *Attorney, Agent, or Firm*—Kirkpatrick & Lockhart LLP

(57) ABSTRACT

A computer-assisted method for controlling the delivery of fuel to an engine. The method includes receiving an input signal indicative of a sensed speed of the engine, validating that the engine is in a cruise power mode based on the input signal, and providing an output signal based on a sensed engine operating condition for adaptively controlling the fuel delivery to the engine when the engine is operating in the cruise power mode. Also, a fuel control module. The fuel control module includes a first portion configured for receiving an input signal indicative of a sensed speed of an engine, a second portion configured for validating that the engine is operating in a cruise power mode based on the input signal, and a third portion configured for providing an output signal based on a sensed engine operating condition for controlling fuel delivery to the engine when the engine is operating in the cruise power mode.

32 Claims, 4 Drawing Sheets

AUTOMATIC AIRCRAFT ENGINE FUEL MIXTURE OPTIMIZATION

CROSS-REFERENCE TO RELATED APPLICATIONS (Not Applicable)

STATEMENT REGARDING FEDERALLY SPONSORED RESEARCH (Not Applicable)

BACKGROUND OF THE INVENTION

1. Field of the Invention

The present invention is directed generally to a method and system for controlling the fuel delivery to an engine and, more particularly, to a method and system for controlling the fuel delivery to an engine using adaptive techniques.

2. Description of the Background

In certain applications of internal combustion piston engines, it is desirable to supply an over-rich fuel to air mixture under certain operating conditions. For example, during take-off and climb of an aircraft, the aircraft engine must typically be supplied an over-rich fuel to air mixture. The pilot of the aircraft must manually weaken the mixture when the aircraft reaches low power cruising conditions. The pilot must monitor relevant engine operating parameters via the cockpit instrumentation to periodically adjust the fuel mixture. The fuel mixture must be precisely determined because of the need to ensure adequate fuel supply and to limit engine temperature during the high power, flight safety critical, portions of the aircraft's flight. Thus, the pilot has to devote considerable and constant attention to the instruments to ensure that the fuel flow is reduced during cruise conditions. Typically, the pilot monitors the engine temperature and power reading instruments to set the fuel mixture within pre-defined parameters at which it is assumed that the ideal engine operating point will be attained. The pilot must also monitor the aircraft speed and altitude and ambient temperature and pressure variations, which can affect the required fuel mixture.

When a pilot must devote attention to the aircraft flight path, other aircraft in the vicinity, etc., the pilot may fail to properly weaken the fuel mixture. This results in high levels of exhaust pollutant emissions, carbon buildup on cylinder head components, and, possibly, such high fuel consumption that the planned flight duration of the aircraft may not be achievable. Also, an overly weak fuel mixture can result in reduced engine life due to the overheating of cylinder head components and can also result in a failure of the engine to adequately respond if it were suddenly necessary for the pilot to increase engine power for some flight situation purpose.

In addition to engines which rely on manual pilot intervention to set the fuel mixture, some aircraft engines have electronic engine controls which measure the relevant engine and aircraft operating parameters, digitally process the information, and activate effectors which automatically set the fuel mixture (and other engine functions such as ignition timing) according to preset scheduled values. These systems have the disadvantage in that they rely on predetermined engine characteristic schedules, typically for an average or minimum rated power engine. Thus, they do not take into account engine to engine variations or changes in the desired schedule characteristics with performance changes over the service life of the engine. Thus, under certain conditions, an engine could operate at a fuel mixture as much as five percent away from its ideal stoichiometric fuel mixture.

Thus, there is a need for a system and method for controlling the fuel delivery to an engine which requires no pilot intervention. There is also a need for a system and method for controlling the fuel delivery to an engine which does not rely on predetermined engine characteristic schedules to determine the amount of fuel to deliver to the engine.

SUMMARY OF THE INVENTION

The present invention is directed to a computer-assisted method for controlling the delivery of fuel to an engine. The method includes validating that the engine is in a cruise power mode and adaptively controlling the fuel delivery to the engine based on sensed engine operating conditions.

The present invention represents a substantial advance over prior systems and methods for controlling the fuel delivery to an engine. The present invention has the advantage that it provides for a system and method for controlling the fuel delivery to an engine which requires no pilot intervention. The present invention also has the advantage that it provides for a system and method for controlling the fuel delivery to an engine which does not rely on predetermined engine characteristic schedules to determine the amount of fuel to deliver to the engine.

BRIEF DESCRIPTION OF THE DRAWINGS

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements found in a typical aircraft propulsion and control system. For example, specific operating system details and modules contained in the electronic engine controller are not shown. Also, the power supply, specific ignition timing system components, and certain fuel system components are not shown. Those of ordinary skill in the art will recognize that other elements may be desirable to produce an operational system incorporating the present invention. However, because such elements are well known in the art, and because they do not facilitate a better understanding of the present invention, a discussion of such elements is not provided herein.

Figure 1:
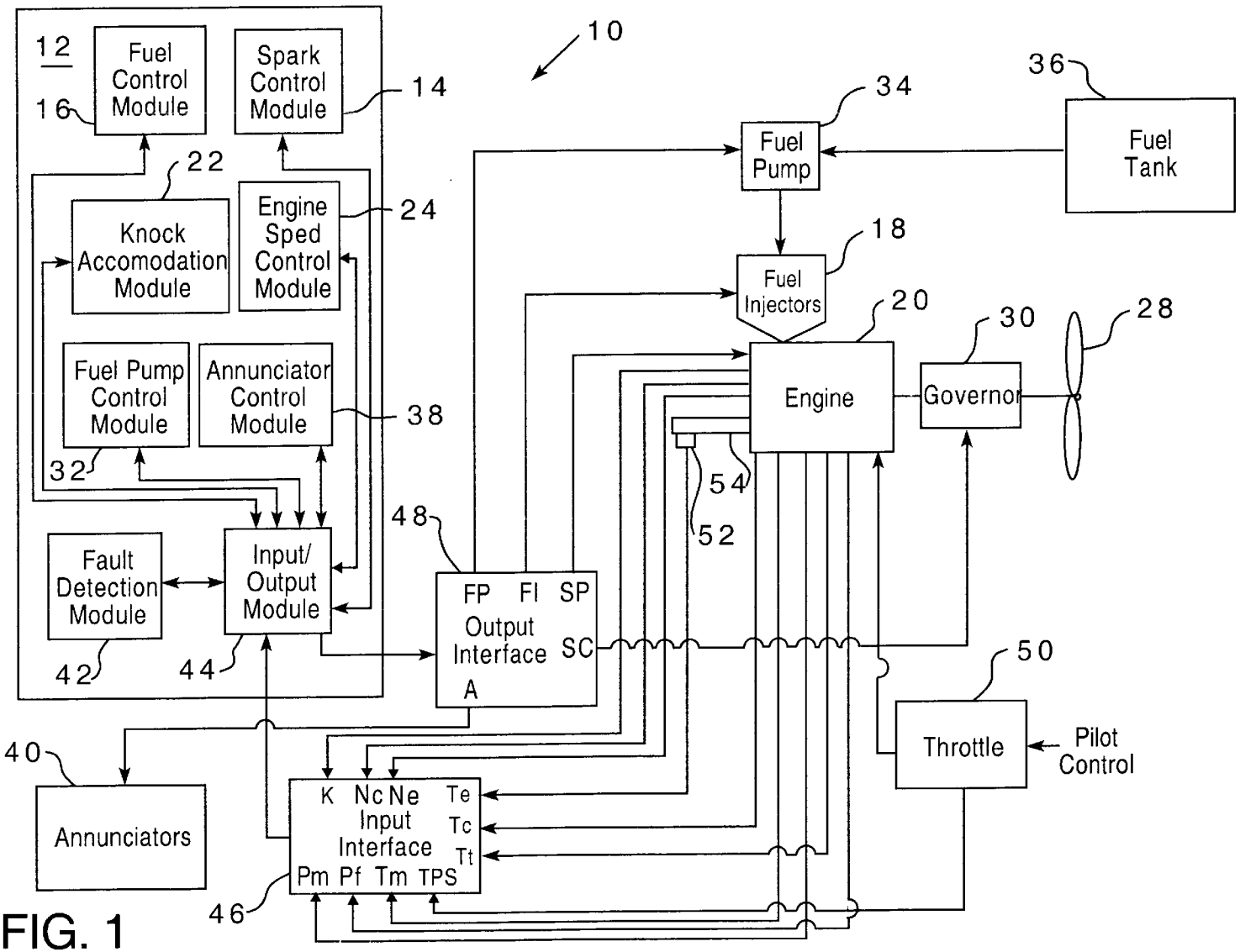
FIG. 1 is a diagram illustrating an aircraft propulsion and control system in which the present invention may be used.

FIG. 1 is a diagram illustrating an aircraft propulsion and control system 10 in which the present invention may be used. The system 10 is described herein as implemented in an aircraft, although it may be implemented in any combustion engine. The system 10 can be used in an engine with any number of cylinders such as, for example, a four, six, or eight cylinder engine. In addition, the system 10 can be implemented in a naturally or supercharged aspirated, air cooled, horizontally opposed, reciprocating direct drive engine.

An electronic engine controller 12 accepts various engine parameters as inputs and outputs various control signals to control portions of the system 10. The controller 12 includes a spark control module 14, which generates signals directing the charging and discharging of spark plug ignition coils (not shown) to control ignition timing and energy level. The operation of the module 14 is detailed in the patent application "System and Method for Ignition Spark Energy Optimization", which was filed concurrently herewith by the assignee of the instant application, and which is incorporated herein by reference. A fuel control module 16 generates signals which control the amount of fuel that is delivered by fuel injectors 18. It is desirable to have one fuel injector per cylinder of an engine 20. The fuel injectors 18 can be, for example, electromagnetically operated valves which have coils that can be energized and de-energized to open and close the valves. An appropriate fuel injector is detailed in the patent application "Fuel Injector Assembly ", which was filed concurrently herewith by the assignee of the instant application, and which is incorporated herein by reference. A knock accommodation module 22 generates signals which control engine detonation, or knock, by retarding ignition timing and enriching the fuel mixture at the fuel injectors 18. An engine speed control module 24 generates signals which determine how much current should be applied to a coil (not shown) in a governor 30 to change the angle of a propeller 28.

A fuel pump control module 32 generates signals which control the delivery of fuel by an electric fuel pump 34 from a fuel tank 36 to the fuel injectors 18. An annunciator control module 38 generates signals which determine which of annunciators 40, if any, are illuminated such as during a component failure or when conditions such as low engine oil pressure or high engine oil temperature are present. A fault detection module 42 detects faults in the controller 12 and, upon confirming the presence of a fault, annunciates the fault via the annunciators 40.

An input/output module 44 receives input signals from the an input interface 46 and outputs signals via an output interface 48. The input interface 46 receives various input signals from sensors throughout the system 10. The interface 46 receives a manifold pressure signal Pm from a manifold pressure sensor (not shown) which can be located on, for example, the body of a throttle 50 or on the induction plenum (not shown) or induction splitter (not shown) of the engine 20. The throttle 50 controls the amount of air that is introduced into the cylinders (not shown) of the engine 20. The interface 46 receives a fuel pressure signal Pf from a fuel pressure sensor (not shown) which can be mounted on, for example, the fuel distribution block (not shown) of the engine 20. The manifold pressure and fuel pressure sensors can be, for example, resistance strain gauges. The interface 46 receives a manifold temperature signal Tm from a manifold temperature sensor (not shown) which can be located on, for example, the body of the throttle 50 or on the induction plenum (not shown) or induction splitter (not shown) of the engine 20. The manifold temperature sensor can be, for example, a thermistor. The interface 46 receives a throttle position sensor signal TPS from a throttle position sensor (not shown) located on the body of the throttle 50. The throttle position sensor can be, for example, a potentiometer. The interface 46 receives a turbine inlet temperature sensor signal Tt from a turbine inlet sensor of the engine 20. The interface 46 receives a cylinder head temperature signal Tc from a cylinder head temperature sensor located on, for example, the thermowells of each cylinder (not shown) of the engine 20. The turbine inlet temperature and the cylinder head temperature sensors can be, for example, thermistors. The interface 46 receives an exhaust gas temperature signal Te from an exhaust gas temperature sensor 52 which are located in each exhaust pipe 54 at, for example, a location approximately 2 inches from the exhaust pipe to cylinder mating flange (not shown). The exhaust gas temperature sensor can be, for example, a thermocouple. The interface 46 receives a crankshaft speed sensor signal Ne and a camshaft speed sensor signal Nc from a speed sensor assembly (not shown) which is mounted on the engine 20. The crankshaft speed and camshaft speed sensors can be, for example, Hall effect, magnetically biased, magnetic pickups. The interface 46 receives a knock sensor signal K from a knock sensor (not shown) which is located on, for example, the cylinder heads of air cooled engines and the engine case for unitized block liquid cooled engines. The knock sensor can be, for example, a piezoelectric accelerometer.

The output interface 48 outputs a spark signal SP, which is generated by the spark control module 14 and the knock accommodation module 22, to control the spark coil current and timing of pulses to interrupt the spark coil primary winding current and generate a spark at each spark plug (not shown) located in the engine 20. The interface 48 outputs a fuel injection signal FI, which is generated by the fuel control module 16 and the knock accommodation module 22, to control the opening and closing of the valves (not shown) in the fuel injectors 18. The interface 48 outputs a speed control signal SC, which is generated by the engine speed control module 24, to the governor 30. The signal SC can be, for example, a pulse width modulated signal that causes the governor 30 to change the pitch of the propeller 28 as appropriate. The interface 48 outputs a fuel pump control signal FP, which is generated by the fuel pump control module 32, to control the operation of the fuel pump 34. The output interface 48 outputs an annunciator signal A, which is generated by the annunciator control module 38, to the annunciators 40.

The interfaces 46 and 48 can be implemented using, for example, one or a plurality of RS-485 serial data buses.

The controller 12 can be implemented as, for example, a microprocessor such as, for example, an N87C196KT microprocessor, sold by Intel Corporation of Santa Clara, California, with or without internal memory or an application specific integrated circuit (ASIC). The modules 14, 16, 22, 24, 32, 38, 42 and 44 can be implemented using any type of computer instruction types such as, for example, microcode, and can be stored in, for example, an electrically erasable programmable read only memory (EEPROM) or can be configured into the logic of the controller 12. The controller 12 can be mounted on, for example, the mount frame (not shown) of the engine 20 or on either side of the firewall (not shown) of the engine 20.

The module 16 utilizes a closed loop "hill climbing" adaptive technique when the engine 20 is in a cruise power mode. The module 16 first validates that the engine 20 is in cruise power mode and then calibrates the delivery of fuel to the engine 20 to maintain a stoichiometric mixture.

Figure 2:
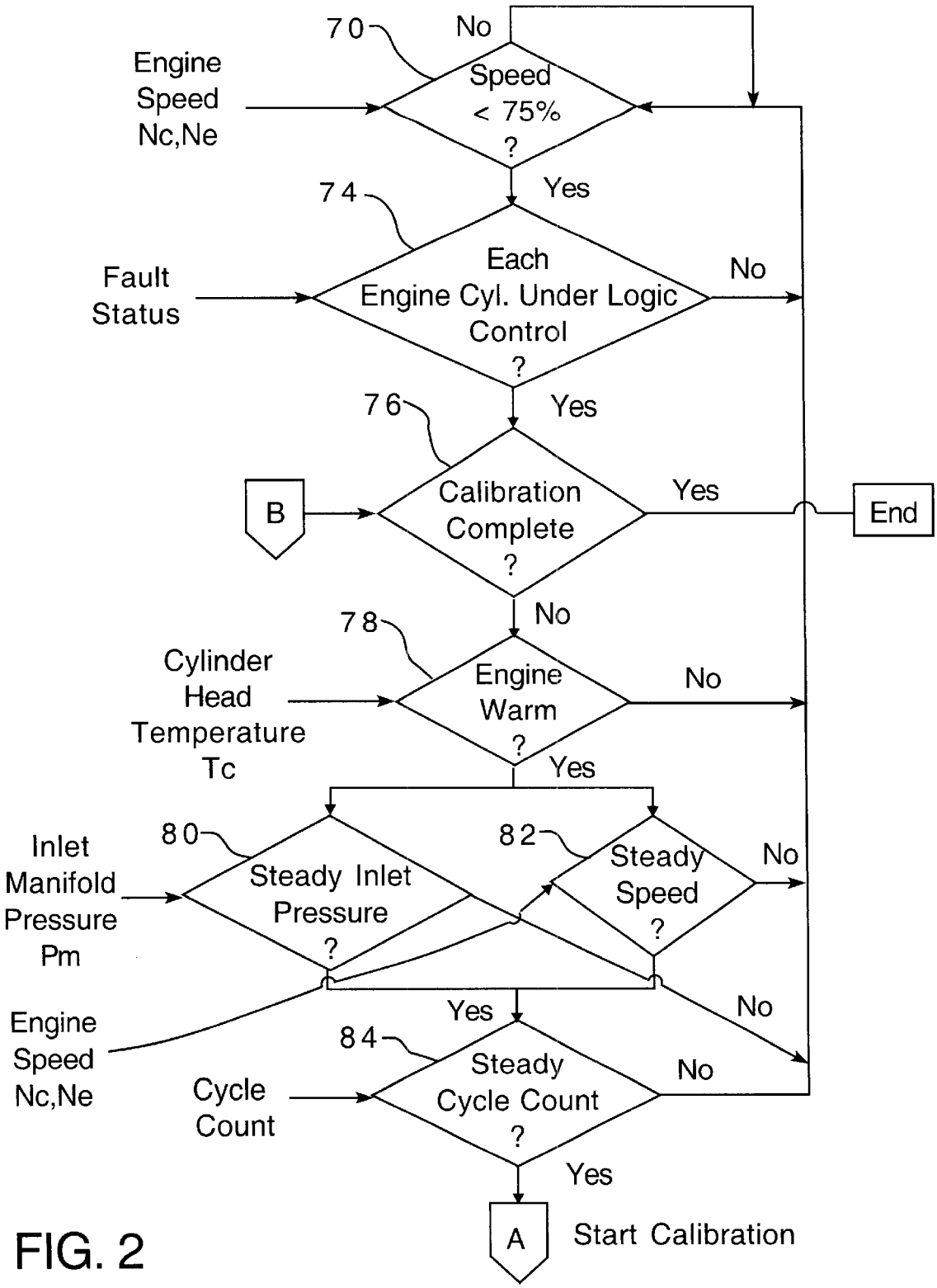
FIG. 2 is a diagram illustrating a process flow through the fuel control module illustrated in FIG. 1 during the validation process.

FIG. 2 is a diagram illustrating a process flow through the fuel control module 16 illustrated in FIG. 1 during a validation process. The validation process ensures that the aircraft is operating in an appropriate cruise power mode so that a calibration process may be entered to control the fuel delivery to the engine 30 such that a stoichiometric fuel/air mixture is found. The flow through the module 16 enters at block 70, where the controller 12 determines if the aircraft is being operated in a cruise power mode by determining, based on the speed sensor signals Nc and Ne, whether the speed of the engine 20 is below a maximum power speed such as, for example, 75% of the maximum speed of the engine 20. This check is necessary to prevent the calibration process of the module 16 from being inhibited by excessively high engine temperatures that could occur at high engine speeds. Alternatively, a pilot-activated switch could be used at block 70. If the speed is not less than the maximum power speed, the flow remains at block 70. If the speed is less than the maximum power speed, the flow advances to block 74.

Figure 3:
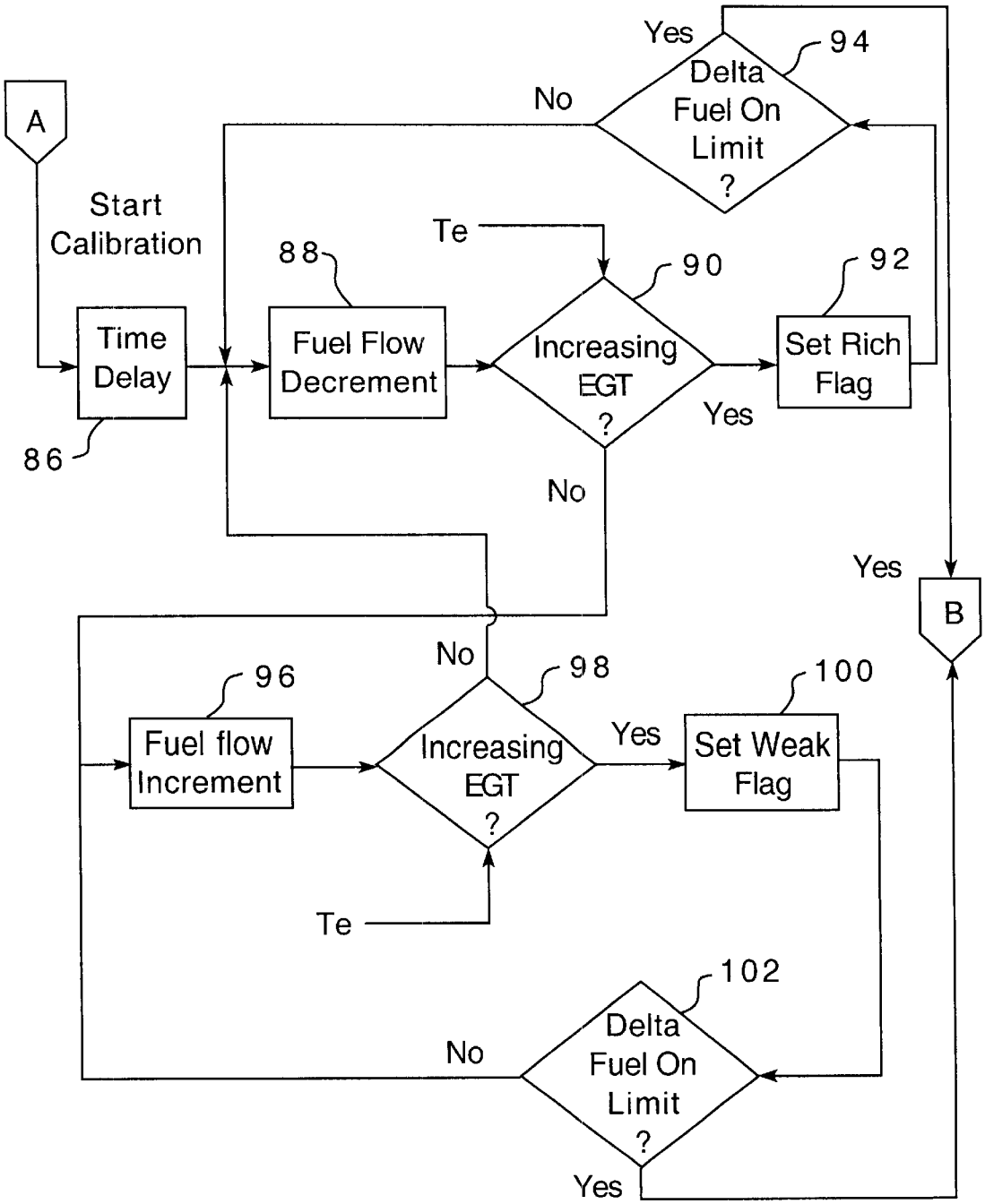
FIG. 3 is a diagram illustrating a process flow through the fuel control module illustrated in FIG. 1 during the calibration process.

At block 74, the module 16 determines, based on the fault status generated by the fault detection module 42, whether each cylinder of the engine 20 is under control of nominated control logic in the controller 12 rather than backup logic in the controller 12. The backup logic would control a cylinder if a control fault had been previously detected by the controller 12. If the logic is not under the control of the nominated control logic, the flow moves to block 70. If the logic is under the control of the nominated control logic, the flow moves to block 76. At block 76, the module 16 determines if the calibration process, as discussed hereinbelow in conjunction with FIG. 3, is complete (i.e. a stoichiometric fuel mixture has been found). If the calibration process is not complete, the module 16 determines at block 78 whether the engine 20 has attained a minimum operating temperature as measured by the cylinder head temperature signal Tc. The minimum temperature can be, for example, 380° F. If the calibration is complete, the flow ends at block 77.

The module 16 determines, at blocks 80, 82, and 84, whether the engine 20 is running steadily without significant transient perturbations. At block 80, the module 16 determines if the engine 20 has a steady inlet manifold pressure as measured by the manifold pressure signal Pm. At block 82, the module 16 determines if the engine 20 is operating at a steady speed as measured by the crankshaft and camshaft speed sensor signals Ne and Nc. If the inlet pressure or the engine speed are not steady, the flow moves to block 70. If the inlet pressure and the engine 20 speed are steady, the module 16 determines at block 84 whether the inlet pressure and the engine 20 speed have been steady for a predetermined cycle count. Such a cycle count could be, for example, 1500 engine cycles. If the inlet manifold pressure and the engine 20 speed were not steady for the cycle count, flow returns to blocks 80 and 82. If the inlet manifold pressure and the engine 20 speed were steady for the cycle count, flow moves to the calibration process, which is discussed hereinbelow in conjunction with FIG. 3.

FIG. 3 is a diagram illustrating a process flow through the fuel control module 16 illustrated in FIG. 1 during the calibration process. The flow starts at block 86, where a short time delay is introduced to reset the logic decision blocks in the controller 12 as necessary. The time delay can be, for example, 50 engine cycles. The flow then moves to block 88, where the module 16 commands the appropriate injector of the fuel injectors 18, via the FI output signal, to decrease the amount of fuel metered by the that injector, thus weakening the fuel to air mixture introduced to the cylinder of the engine 20 that is about to fire. The fuel can be decremented by, for example, 0.001 fuel/air ratio per every 50 engine cycles. The flow then moves to block 90, where the module 16 determines, based on the exhaust gas temperature signal Te, if the exhaust gas temperature has increased or decreased in response to the fuel flow decrement of block 88. If the exhaust gas temperature is increasing, a rich flag is set at block 92, which indicates that the fuel to air ratio is too rich. After the rich flag is set at block 92, the module 16 checks, at block 94, whether the maximum permitted fuel flow reduction (Δ) has been reached. The maximum permitted reduction is a preset limit used to prevent unsafe operation of the engine 20 if it has significantly diverged from its design point due to, for example, engine wear or an undetected fault condition. The maximum permitted reduction can be, for example, to a full lean mixture. If the maximum reduction has been reached, the flow proceeds to block 76 of FIG. 2 to indicate that calibration is complete. If the maximum reduction has not been reached, the flow moves to block 88, where the fuel flow is further decremented.

If the exhaust gas temperature is not increasing as determined at block 90, the fuel to air mixture is weak, i.e. the mixture is on the "lean" side of the stoichiometric operating point of the engine 20. The flow thus advances to block 96, where the fuel flow is incremented. The flow then advances to block 98, where the module 16 determines, via the exhaust gas temperature signal Te, if the exhaust gas temperature is increasing. If the exhaust gas temperature is increasing, the flow moves to block 100, where a weak flag is set indicating that the fuel to air mixture is weak. The flow then advances to block 102, where the module 16 determines whether the maximum permitted fuel flow increase (Δ) has been reached. The maximum permitted increase is a preset limit used to prevent unsafe operation of the engine 20 if it has significantly diverged from its design point due to, for example, engine wear or an undetected fault condition. The maximum permitted increase can be, for example, to a full rich mixture. If the maximum increase has been reached, the flow proceeds to block 76 of FIG. 2 to indicate that calibration is complete. If the maximum permitted increase is not present as determined at block 102, the flow moves to block 96, where the fuel flow is further incremented. The fuel flow can be incremented by, for example, 0.001 fuel/air ratio per every 150 engine cycles.

If the exhaust gas temperature is not increasing as determined at step 98, the flow advances to step 88, where the fuel flow is decremented.

The calibration process described in conjunction with FIG. 3 thus locates the stoichiometric operating point of the engine 20. The engine 20 thus continues to operate around the stoichiometric point and the fuel flow alternately moves between slightly rich and slightly lean. This ensures that the stoichiometric operating point is maintained even if slight changes in ambient temperature and pressure, or small changes in the aircraft flight path, affect the engine 20 operating point.

Figure 4:
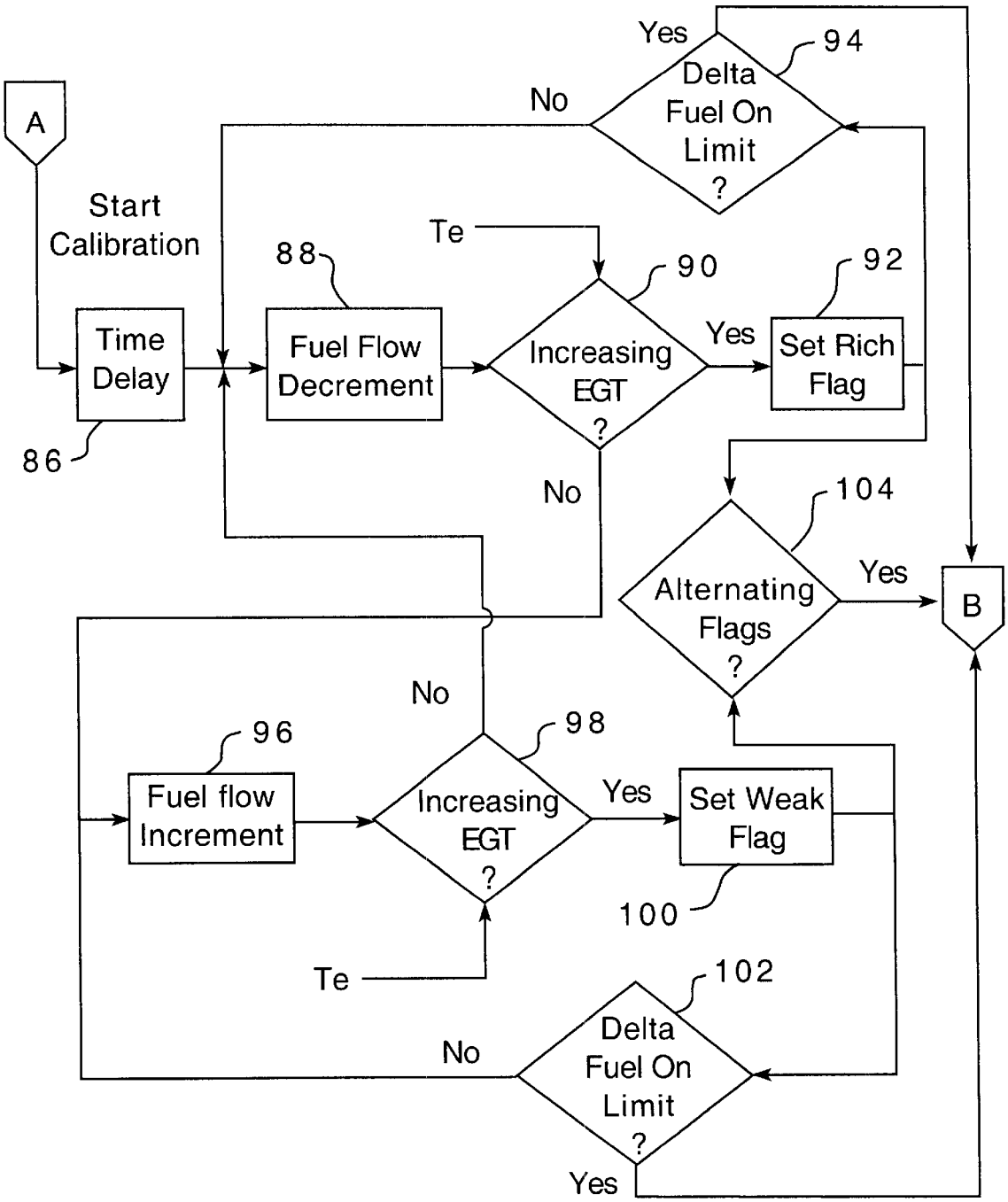
FIG. 4 is a diagram illustrating another process flow through the fuel control module illustrated in FIG. 1 during the calibration process.

FIG. 4 is a diagram illustrating another embodiment of a process flow through the fuel control module 16 illustrated in FIG. 1 during the calibration process. The operation of the flow illustrated in FIG. 4 is similar to that of the operation of the flow illustrated in FIG. 3. However, when the rich flag is set at block 92 or the weak flag is set at block 100, block 104 performs a check to determine if a rich flag was immediately set after a weak flag was set or a weak flag was immediately set after a rich flag was set. If one of these conditions exists, the flow advances to block 76 of FIG. 2 to indicate that the calibration process has ended. The engine 20 thus continues to operate without perturbation in fuel flow using the operating point determined using the process of FIG. 4. If the flag check at block 104 determines that a rich flag was not immediately set after a weak flag was set or a weak flag was not immediately set after a rich flag was set, the flow advances to either block 94 or 102, depending on whether block 104 was entered from block 92 or block 100.

Although the calibration processes illustrated in conjunction with FIGS. 3 and 4 use the exhaust gas temperature signal Te to monitor the fuel to air mixture, other parameters may be used. For example, the engine 20 cylinder head temperature signal Tc could be used in place of or in combination with the signal Te.

While the present invention has been described in conjunction with preferred embodiments thereof, many modifications and variations will be apparent to those of ordinary skill in the art. The foregoing description and the following claims are intended to cover all such modifiction and variations.

We claim:

1. An engine control system, comprising:

at least one fuel injector; and an engine controller in communication with the at least one fuel injector, the engine controller including:

a first module configured for receiving an input signal indicative of a sensed speed of an engine; and a second module configured for:

validating that the engine is operating in a cruise power mode based on the input signal; and providing an output signal based on a sensed engine operating condition for controlling fuel delivery within a stoichiometric mixture to the at least one fuel injector when the engine is operating in the cruise power mode by alternating fuel delivery between a rich mixture and a lean mixture to the at least one fuel injector.

2. The system of claim 1, wherein the sensed engine operating condition includes changes in a measured exhaust gas temperature signal.

3. An engine control system, comprising:

at least one fuel injector; and an engine controller in communication with the at least one fuel injector, the engine controller including:

a first module configured for receiving an input signal indicative of a sensed speed of an engine; and a second module configured for:

validating that the engine is operating in a cruise power mode based on the input signal; and providing an output signal based on a measured exhaust gas temperature variation for calibrating fuel delivery to maintain a stoichiometric mixture to the at least one fuel injector when the engine is operating in the cruise power mode by alternating fuel delivery between a rich mixture and a lean mixture to the engine.

4. A fuel control module, comprising:

a first portion configured for receiving an input signal indicative of a sensed speed of an engine;

a second portion configured for validating that the engine is operating in a cruise power mode based on the input signal; and a third portion configured for providing an output signal based on a sensed engine operating condition for controlling fuel delivery within a stoichiometric mixture to the engine when the engine is operating in the cruise power mode by alternating fuel delivery between a rich mixture and a lean mixture to the engine.

5. A fuel control module, comprising:

a first portion configured for receiving an input signal indicative of a sensed speed of an engine;

a second portion configured for validating that the engine is operating in a cruise power mode based on the input signal; and a third portion configured for providing an output signal based on a measured exhaust gas temperature variation for calibrating fuel delivery to the engine to maintain a stoichiometric mixture when the engine is operating in the cruise power mode by alternating fuel delivery between a rich mixture and a lean mixture to the engine.

6. A computer-readable medium having stored thereon instructions which, when executed by a processor, cause the processor to:

validate that an engine is in a cruise power mode based on a sensed speed of the engine; and adaptively control the fuel delivery within a stoichiometric mixture to the engine based on sensed engine operating conditions when the engine is operating in the cruise power mode by alternating fuel delivery between a rich mixture and a lean mixture to the engine.

7. A computer-readable medium having stored thereon instructions which, when executed by a processor, cause the processor to:

validate that an engine is in a cruise power mode based on a sensed speed of the engine; and calibrate fuel delivery to maintain a stoichiometric mixture to the engine based on measured exhaust gas temperature variations by alternating fuel delivery between a rich mixture and a lean mixture to the engine.

8. A computer-assisted method for controlling the delivery of fuel to an engine, comprising:

receiving an input signal indicative of a sensed speed of the engine;

validating that the engine is in a cruise power mode based on the input signal; and providing an output signal based on a sensed engine operating condition for adaptively controlling the fuel delivery to the engine when the engine is operating in the cruise power mode, wherein adaptively controlling the fuel delivery to the engine includes adaptively controlling the fuel delivery to the engine within a stoichiometric mixture.

9. The method of claim 8, wherein adaptively controlling the fuel delivery to the engine includes adaptively controlling the fuel delivery to the engine based on a measured exhaust gas temperature.

10. The method of claim 8, wherein adaptively controlling the fuel delivery to the engine includes adaptively controlling the fuel delivery to the engine based on a measured cylinder head temperature.

11. A computer-assisted method for controlling the delivery of fuel to an engine, comprising:

receiving an input signal indicative of a sensed speed of the engine;

validating that the engine is in a cruise power mode based on the input signal; and providing an output signal based on a sensed engine operating condition for adaptively controlling the fuel delivery to the engine when the engine is operating in the cruise power mode, wherein adaptively controlling the fuel delivery to the engine includes alternating the fuel delivery between a rich mixture and a lean mixture.

12. The method of claim 11, wherein adaptively controlling the fuel delivery to the engine includes adaptively controlling the fuel delivery to the engine based on a measured exhaust gas temperature.

13. The method of claim 11, wherein adaptively controlling the fuel delivery to the engine includes adaptively controlling the fuel delivery to the engine based on a measured cylinder head temperature.

14. A computer-assisted method for controlling the delivery of fuel to an engine, comprising:

receiving an input signal indicative of a sensed speed of the engine;

validating that the engine is in a cruise power mode based on the input signal; and providing an output signal based on a sensed engine operating condition for adaptively controlling the fuel delivery to the engine when the engine is operating in the cruise power mode, wherein adaptively controlling the fuel delivery to the engine includes supplying one of a lean mixture and a rich mixture to the engine.

15. The method of claim 14, further comprising:

determining whether a lean mixture immediately followed by a rich mixture was supplied to the engine; and maintaining the fuel delivery at a last delivered mixture when a lean mixture immediately followed by a rich mixture was supplied to the engine.

16. The method of claim 14, further comprising:

determining whether a rich mixture immediately followed by a lean mixture was supplied to the engine; and maintaining the fuel delivery at a last delivered mixture when a rich mixture immediately followed by a lean mixture was supplied to the engine.

17. The method of claim 14, wherein adaptively controlling the fuel delivery to the engine includes adaptively controlling the fuel delivery to the engine based on a measured exhaust gas temperature.

18. The method of claim 14, wherein adaptively controlling the fuel delivery to the engine includes adaptively controlling the fuel delivery to the engine based on a measured cylinder head temperature.

19. A computer-assisted method for controlling the delivery of fuel to an engine, comprising:

receiving an input signal indicative of a sensed speed of the engine;

validating that the engine is in a cruise power mode based on the input signal, wherein validating that the engine is in a cruise power mode includes:

determining whether a measured speed of the engine is less than a predetermined speed;

determining whether each cylinder of the engine is under control of a nominated control logic when the engine speed is less than the predetermined speed;

determining whether a measured temperature of the engine is greater than a predetermined minimum temperature when each cylinder of the engine is under control of the nominated control logic; and determining whether a measured inlet pressure and the measured speed of the engine are steady for a predetermined number of engine cycles when the measured temperature of the engine is greater than the predetermined minimum temperature; and providing an output signal based on measured exhaust gas temperature variations for calibrating fuel delivery to the engine when the engine is operating in the cruise power mode.

20. The method of claim 19, wherein the predetermined speed is 75% of a maximum speed.

21. The method of claim 19, wherein the predetermined minimum temperature is 380° F.

22. The method of claim 19, wherein the predetermined number of engine cycles is 1500.

23. The method of claim 19, wherein calibrating fuel delivery to the engine includes:

(a) decreasing the fuel delivery to the engine;

(b) determining if a measured temperature of the engine is increasing;

(c) decreasing the fuel delivery to the engine when the measured temperature of the engine is increasing;

(d) increasing the fuel delivery to the engine when the measured temperature of the engine is not increasing; and (e) repeating steps (b)–(d) until a change in the fuel delivery to the engine reaches a predetermined limit.

24. The method of claim 19, wherein calibrating fuel delivery to the engine includes:

(a) decreasing the fuel delivery to the engine;

(b) determining if a measured temperature of the engine is increasing;

(c) decreasing the fuel delivery to the engine when the measured temperature of the engine is increasing;

(d) increasing the fuel delivery to the engine when the measured temperature of the engine is not increasing; and (e) repeating steps (b)–(d) until one of a change in the fuel delivery to the engine reaches a predetermined limit, the fuel delivery is decreased and then immediately increased, and the fuel delivery is increased and then immediately decreased.

25. A computer-assisted method for controlling the delivery of fuel to an engine, comprising:

receiving an input signal indicative of a sensed speed of the engine;

validating that the engine is in a cruise power mode based on the input signal; and providing an output signal based on measured exhaust gas temperature variations for calibrating fuel delivery to the engine when the engine is operating in the cruise power mode, wherein calibrating fuel delivery to the engine includes:

(a) decreasing the fuel delivery to the engine;

(b) determining if a measured temperature of the engine is increasing;

(c) decreasing the fuel delivery to the engine when the measured temperature of the engine is increasing;

(d) increasing the fuel delivery to the engine when the measured temperature of the engine is not increasing; and (e) repeating steps (b)–(d) until a change in the fuel delivery to the engine reaches a predetermined limit.

26. The method of claim 25, wherein the predetermined speed is 75% of a maximum speed of the engine.

27. The method of claim 25, wherein the predetermined minimum temperature is 380° F.

28. The method of claim 25, wherein the predetermined number of engine cycles is 1500.

29. A computer-assisted method for controlling the delivery of fuel to an engine, comprising:

receiving an input signal indicative of a sensed speed of the engine;

validating that the engine is in a cruise power mode based on the input signal; and providing an output signal based on measured exhaust gas temperature variations for calibrating fuel delivery to the engine when the engine is operating in the cruise power mode, wherein calibrating fuel delivery to the engine includes:

(a) decreasing the fuel delivery to the engine;

(b) determining if a measured temperature of the engine is increasing;

(c) decreasing the fuel delivery to the engine when the measured temperature of the engine is increasing;

(d) increasing the fuel delivery to the engine when the measured temperature of the engine is not increasing; and (e) repeating steps (b)–(d) until one of a change in the fuel delivery to the engine reaches a predetermined limit, the fuel delivery is decreased and then immediately increased, and the fuel delivery is increased and then immediately decreased.

30. The method of claim 29, wherein the predetermined speed is 75% of a maximum speed of the engine.

31. The method of claim 29, wherein the predetermined minimum temperature is 380° F.

32. The method of claim 29, wherein the predetermined number of engine cycles is 1500.

* * * * *